US011195385B2

(12) United States Patent
Palmisano

(10) Patent No.: US 11,195,385 B2
(45) **Date of Patent: *Dec. 7, 2021**

(54) METHOD AND ASSOCIATED HARDWARE FOR AWARDING A BONUS

(71) Applicant: Aristocrat Technologies, Inc., Las Vegas, NV (US)

(72) Inventor: Angelo Palmisano, Henderson, NV (US)

(73) Assignee: ARISTOCRAT TECHNOLOGIES, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/859,480

(22) Filed: Apr. 27, 2020

(65) Prior Publication Data

US 2020/0265687 A1 Aug. 20, 2020

Related U.S. Application Data

(63) Continuation of application No. 14/199,130, filed on Mar. 6, 2014, now Pat. No. 10,891,831.

(60) Provisional application No. 61/840,185, filed on Jun. 27, 2013.

(51) Int. Cl.
*G07F 17/34* (2006.01)
*G07F 17/32* (2006.01)

(52) U.S. Cl.
CPC ..... *G07F 17/34* (2013.01); *G07F 17/3246* (2013.01)

(58) Field of Classification Search
CPC ..... G07F 17/34; G07F 17/3246; G07F 17/32
USPC ..... 463/13
See application file for complete search history.

(56) References Cited

U.S. PATENT DOCUMENTS

| | | | | |
|---|---|---|---|---|
| 7,008,324 | B1 | 3/2006 | Johnson | |
| 7,022,016 | B2 | 4/2006 | Wood | |
| 7,128,645 | B1 | 10/2006 | White | |
| D601,638 | S | 10/2009 | Palmisano | |
| D631,100 | S | 1/2011 | Palmisano | |
| 7,874,903 | B2 | 1/2011 | White | |
| 2003/0060276 | A1 | 3/2003 | Walker | |
| 2003/0119586 | A1 | 6/2003 | Crumby | |
| 2003/0153384 | A1 | 8/2003 | Duhamel | |
| 2004/0043814 | A1* | 3/2004 | Angell | G07F 17/3202 463/25 |
| 2006/0046816 | A1 | 3/2006 | Walker | |
| 2006/0052157 | A1* | 3/2006 | Walker | G07F 17/32 463/25 |
| 2007/0045958 | A1 | 3/2007 | Rader | |
| 2010/0029381 | A1 | 2/2010 | Vancura | |

(Continued)

OTHER PUBLICATIONS

Office Action dated Jun. 12, 2020 for U.S. Appl. No. 14/199,130 (pp. 1-10).

*Primary Examiner* — Dmitry Suhol
*Assistant Examiner* — Ryan Hsu
(74) *Attorney, Agent, or Firm* — Armstrong Teasdale LLP

(57) ABSTRACT

The method of awarding a bonus includes executing a game so as to define a combination (Step S2); ascertaining if the combination falls within a predefined sub-set of combinations (Step S3), and, if so, setting the combination as a target combination (Step S4). Once a target combination has been set, further games are executed (Step S5), each of which defines a further combination. If the further combination bears a predefined relationship to the target combination (Step S6) then bonus is awarded (Step S7).

18 Claims, 7 Drawing Sheets

(56) References Cited

U.S. PATENT DOCUMENTS

| | | | | |
|---|---|---|---|---|
| 2011/0081964 | A1 | 4/2011 | Acres | |
| 2011/0165925 | A1* | 7/2011 | Moody | G07F 17/3267 463/13 |

* cited by examiner

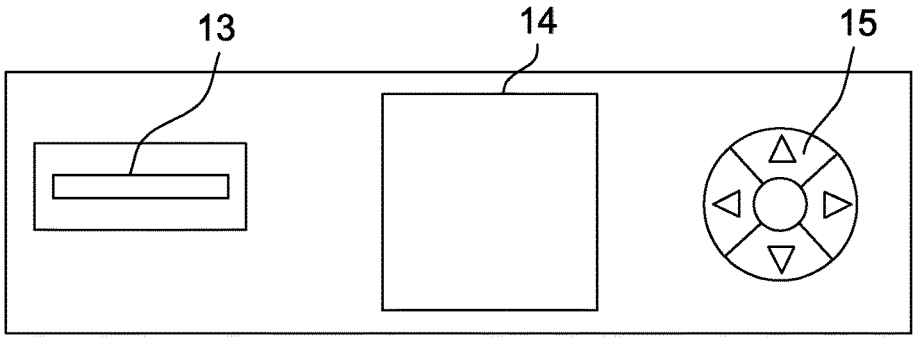

FIG. 5

Selected Poker Hand Details

| | |
|---|---|
| Poker Hand | Use Rules Engine |
| Title | |
| Any | 4 |
| [Inclusive] | Between |
| | Two |
| Through | Ace |
| | Same Rank |
| | Add Clear |

FIG. 6

Selected Poker Hand Details

| | | |
|---|---|---|
| Poker Hand | Custom | |
| Title | | |
| ☑ Card 1 | Select Card Rank | Select Card Suit |
| ☑ Card 2 | Select Card Rank | Select Card Suit |
| ☑ Card 3 | Select Card Rank | Select Card Suit |
| ☑ Card 4 | Select Card Rank | Select Card Suit |
| ☑ Card 5 | Select Card Rank | Select Card Suit |
| | Add Clear | |

FIG. 7

METHOD AND ASSOCIATED HARDWARE FOR AWARDING A BONUS

CROSS-REFERENCE TO RELATED APPLICATION

This application is a continuation of and claims priority to U.S. patent application Ser. No. 14/199,130, filed Mar. 6, 2014, entitled "METHOD AND ASSOCIATED HARDWARE FOR AWARDING A BONUS", which claims the benefit of U.S. Provisional Application No. 61/840,185, filed Jun. 27, 2013. Each patent application identified above is incorporated here by reference in its entirety.

FIELD OF THE INVENTION

The present invention relates to a method and some associated hardware for awarding bonuses. It would typically, although not exclusively, be implemented in a gaming environment, such as in a casino or as an offering of an online service provider.

BACKGROUND

Many modern-day gaming venues provide a variety of games from which patrons may choose. However, in order to maintain or increase player interest and enjoyment there is a need to provide new gaming options. It would be particularly advantageous if new gaming options were to work in conjunction with, provide a new twist to, complement and/or extend, existing popular games.

SUMMARY OF THE INVENTION

In accordance with a first aspect of the present invention there is provided a method of awarding a bonus, the method including:

- executing a game so as to define a combination;
- ascertaining if the combination falls within a predefined sub-set of combinations, and, if so, setting the combination as a target combination;
- executing a further game so as to define a further combination; and
- awarding the bonus if the further combination bears a predefined relationship to the target combination.

In one embodiment the predefined relationship is equality.

Preferably the game and the further game are executed on at least one electronic gaming machine.

In one embodiment the game is a poker game and the further game is a further poker game. In this embodiment the combination is a player's hand at the conclusion of the poker game and the further combination is a player's hand at the conclusion of the further poker game. In this embodiment the predefined sub-set of combinations is a hand type, which may be selected by an operator of the method from a group including: Royal Flush; Straight Flush; Four of a Kind; Full House; Flush; Straight; Three of a Kind; Two Pair; Pair; and High Card. In some embodiments the predefined relationship may be equality irrespective of card suit or equality irrespective of card number.

Some embodiments include defining a concurrent plurality of target combinations and a maximum permitted number of concurrent target combinations may be set by an operator of the method. Preferably a value of the bonus is defined for each of the target combinations.

An embodiment includes a communications module for communicating the target combination to at least one player and also for communicating information relating to the bonus.

In an embodiment the bonus prize is of a predefined value. In another embodiment the bonus prize is of a progressively accumulated value, wherein progressive accumulation of the value commences upon a setting of the target combination and ceases upon an award of the bonus.

In another embodiment the game is a slot machine game and the combination is a symbol combination resulting from the slot machine game. The predefined sub-set of combinations may be a category of symbol combinations or the set of symbol combinations having a common predefined pay level.

In accordance with a second aspect of the present invention there is provided a controller communicatively interfaceable with at least one electronic gaming machine (EGM), the controller being configured to:

- receive a signal from the EGM indicating that the EGM has executed a game and including information indicative of a combination;
- ascertain if the combination falls within a predefined sub-set of combinations, and, if so, set the combination as a target combination;
- receive a further signal from the EGM indicating that the EGM has executed a further game and including information indicative of a further combination; and
- trigger an award of the bonus if the further combination bears a predefined relationship to the target combination.

In accordance with a third aspect of the present invention there is provided a controller communicatively connected to a network of electronic gaming machines (EGM's), each EGM being capable of executing a game, the controller being programmed to:

- receive an operator input so as to define a sub-set of combinations;
- monitor games executed by the EGM's to determine if a combination of one of the games falls within the sub-set of combinations, and, if so, set the aspect as a target combination;
- monitor further games executed by the EGM's to determine if a combination of one of the further games bears a predefined relationship to the target combination, and, if so, trigger an award of the bonus.

In accordance with a fourth aspect of the present invention there is provided a non-transitory computer-readable medium containing computer executable code for instructing a computer to perform the method described above.

In accordance with a fifth aspect of the present invention there is provided at least one downloadable or remotely executable file containing computer executable code for instructing a computer to perform the method described above.

In accordance with a sixth aspect of the present invention there is provided a computing apparatus having a central processing unit, associated memory and storage devices, and input and output devices, said apparatus being configured to perform the method described above.

In accordance with a seventh aspect of the present invention there is provided a method of awarding a bonus, the method including: defining a target combination; executing a game so as to define a game combination; ascertaining if the game combination bears a predefined relationship with the target combination and, if so, adjusting a counter; repeating the preceding two steps until the counter bears a predefined relationship with a threshold; and awarding the bonus once the counter bears the predefined relationship with the threshold.

In one embodiment the target combination is operator defined. In another embodiment the step of defining a target combination includes repeatedly executing the following steps until a target combination is defined: executing a game so as to define a combination; ascertaining if the combination falls within a predefined sub-set of combinations, and, if so, setting the combination as a target combination.

Preferably the threshold is greater than 2.

In one embodiment the games are executed on a plurality of communicatively linked electronic gaming machines (EGM's) and the bonus is awarded to a player of an EGM that caused the counter to bear the predefined relationship with the threshold.

In an embodiment the bonus is awarded to a player of an EGM that is randomly selected from amongst the currently active EGM's. In another embodiment the bonus is divided amongst players of a subset of currently active EGM's. Preferably the subset of currently active EGM's is selected based upon a criterion associated with at least one of the following:

a current session time;

a turnover within a current session; and participation in a player tracking scheme.

According to another aspect of the invention there is provided a method of awarding a bonus, the method including: defining a plurality of target combinations; executing a game so as to define a game combination; ascertaining if the game combination is one of the target combinations; repeating the preceding two steps until each of the target combinations has been respectively matched by a game combination; and awarding the bonus once each of the target combinations have been respectively matched by a game combination.

An embodiment includes the provision of a display for displaying each of the target combinations. The display preferably provides an indication as to whether each of the target combinations has been matched by a game combination.

In one embodiment the games are executable on a plurality of communicatively linked electronic gaming machines (EGM's) and the target combinations are respectively matchable by game combinations arising from games executed on any one of the EGM's.

In another embodiment the games are executable on a single electronic gaming machine (EGM) and the target combinations are respectively matchable by game combinations arising from games executed on the single EGM.

Embodiments of the present invention may be applied to any suitable type of gaming system or platform. It can apply to any stand-alone gaming apparatus or to gaming apparatus that are capable of being linked together, e.g. via a network such as an intranet, and/or to gaming systems provided through computing or other electronic devices, e.g. personal computers, PDAs, mobile telephones, digital televisions, and the like, e.g. over the Internet or other communications networks.

Embodiments may be applied to gaming apparatus that play any suitable game, e.g. slot-machine type games, poker, keno, blackjack, bingo, roulette, pachinko, or the like.

BRIEF DESCRIPTION OF DRAWINGS

An exemplary embodiment of the invention will now be described with reference to the accompanying drawings in which:

FIG. 5 is a front view of a navigation, player tracking & payment unit;

FIG. 6 is a screen shot depicting a rule engine that is operable by an operator of the preferred embodiment to define a sub-set of combinations;

FIG. 7 is a screen shot depicting an interface that is operable by an operator of the preferred embodiment to define a sub-set of combinations;

DETAILED DESCRIPTION

Figure 4:
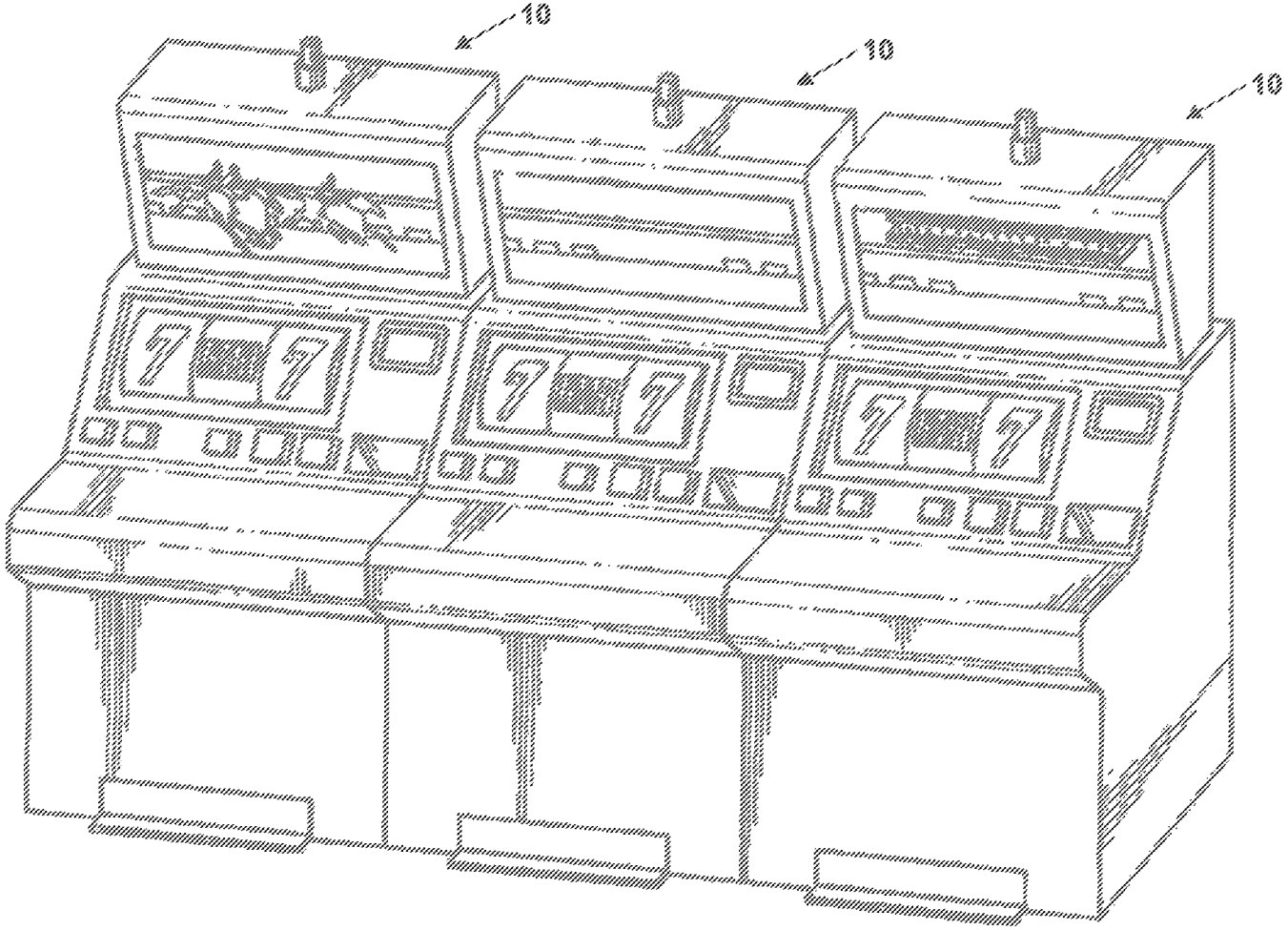
FIG. 4 is a perspective view of a bank of three electronic gaming machines.

Some embodiments of the invention are implemented on a stand-alone electronic gaming machine (EGM), such as one of the EGM's shown in FIG. 4. Other embodiments, such as that illustrated in FIG. 2, relate to a gaming system in which a plurality of gaming devices 10, communicate with a central control system 102 over a network 113, such as a wide area network or local area network.

General Construction of a Gaming Terminal

Figure 1:
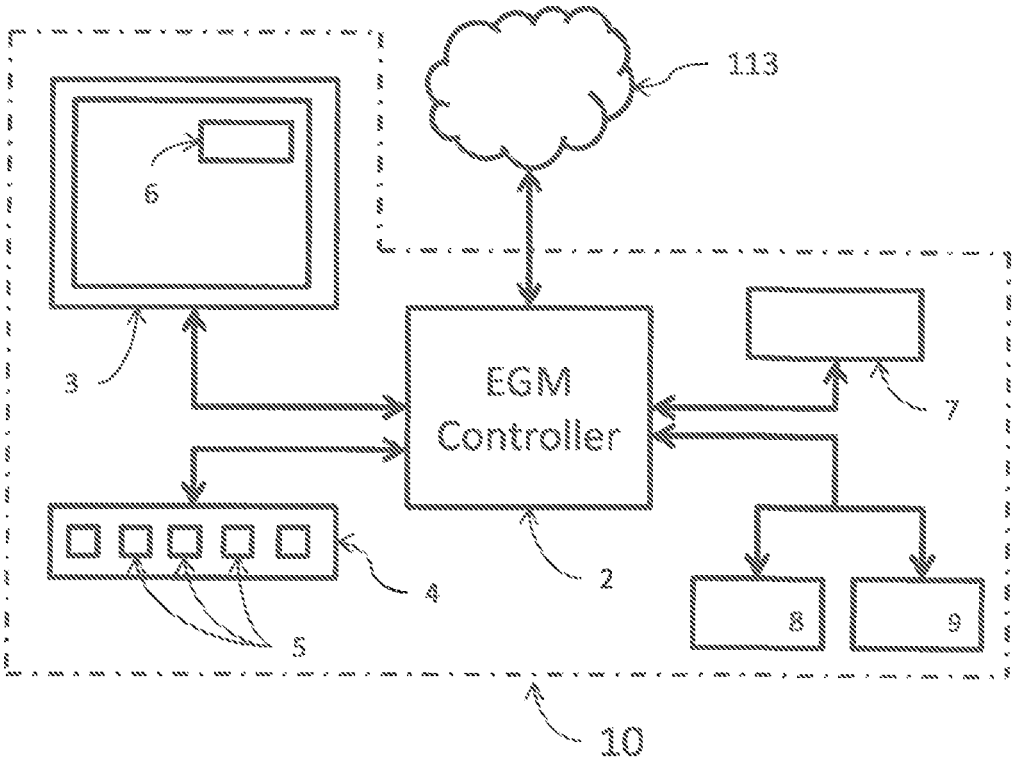
FIG. 1 is a block diagram of a gaming machine for use with an embodiment of the present invention.

Referring to FIG. 1 there is shown an exemplary gaming device 10 for use with a gaming network of the type typically used in casinos and other gaming venues. The gaming device 10 is in the form of an EGM, which includes various standard components, such as a game controller 2, for controlling the operation of the device and the games which run on it. The game controller 2 has a central processing unit (referred to below as a 'processor', which is operatively connected to memory in the form of random access memory or other known forms of digital memory. The device 10 comprises one or more displays 3, such as plasma screen displays, for displaying game screens. A player input means 4 is provided for enabling a user to interact with the device 10 and may include, for example, a bank of buttons 5 located in a mid-trim of the device 10. The buttons 5 may alternatively or additionally be provided as part of the display 3, in a touch-screen type manner.

The device 10 also includes an additional piece of hardware in the form of player tracking module 6, which is shown in more detail in FIG. 5. The player tracking module 6 has a reading device 13 (e.g. a card scanner for reading a loyalty card or other form of portable storage medium capable of being read by the card scanner) which communicates with a player tracking subsystem implemented by the central control system 102 for providing player tracking and loyalty type functions, as is well understood in the art. The player tracking module 6 also includes a display 14 and a player operable input device in the form of directional buttons 15.

The EGM device 10 also implements a note acceptor 7 (also commonly referred to as a bill collector) adapted to accept bank notes as well as cashless instruments, such as paper tickets or coupons, for inputting credits. The note acceptor 7 is additionally configured to dispense notes and tickets/coupons, for paying out winnings. A coin input chute 8 and output tray 9 are provided as an alternative means for inputting credits and dispensing cash winnings, respectively. An in-machine meter (not shown) is also provided to cooperate with the central control system 102 for providing information regarding game plays, amounts of wagers, payoffs, etc. Additional hardware may be included as part of the device 10, or hardware may be omitted as required by the specific implementation.

General System Configuration

Figure 2:
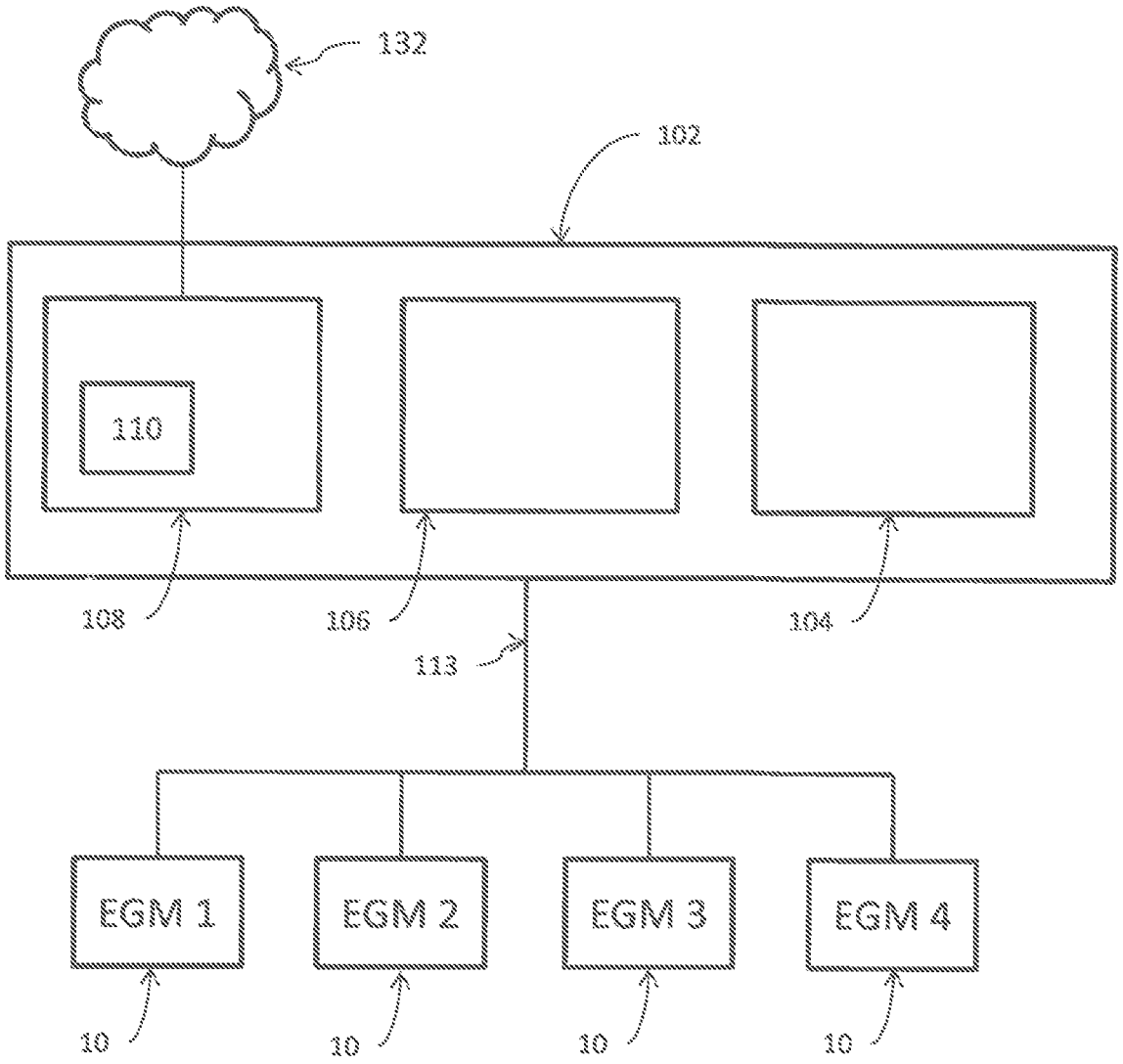
FIG. 2 is a block diagram of a gaming network in accordance with an embodiment.

As alluded to above, and with additional reference to FIG. 2, a plurality of gaming devices 10 may be located on a casino floor (or indeed located in different venues, depending on the network configuration) and be configured to communicate with one or more central control systems 102 by a networked environment, e.g. via wide area network 113. According to the presently described embodiment, the central control system 102 implements three main subsystems as will now be described.

A management and accounting subsystem 104 provides management and accounting functions, also sometimes called auditing functions. Typically, these functions gather and/or report coin-in and coin-out operations, door openings (e.g., when a gaming device is serviced), service cycles in general, ticket replacements, and the like. This activity generally is linked to the game being played on the gaming device and/or the gaming device itself.

A second subsystem, player tracking subsystem 106, provides player tracking functions. More specifically, such systems link players of gaming devices to particular activities undertaken by the players. The information typically tracked for each player includes, for example, the session of game play (e.g., date, time, location, type of machine, type of game, etc.) as well as the individual's profile (e.g., name, address, and/or other identifying information). The player tracking subsystem interfaces with the gaming devices via the player tracking module 6.

A bonusing subsystem 108 provides enhancements which may or may not be related to the base/main game playable on the gaming devices. Such enhancements may relate, for example, to bonusing, progressive games, mystery, secondary games, random rewards (e.g., as disclosed in U.S. Pat. No. 6,626,758, the contents of which are incorporated herein by reference), or any suitable bonus program whereby eligible players may be awarded a bonus prize. The bonusing subsystem 108 is also configured to interface with the gaming devices via the player tracking module 6. Particular methods for the provision of bonuses are discussed in more detail below.

Examples of Methods and Apparatuses for Awarding Bonuses

1. Implementation on a Stand-Alone Poker EGM

This embodiment relates to a bonusing variation that may be implemented on a stand-alone EGM 10 that provides a five-card video poker game. It will be appreciated by those skilled in the art that the player in a typical poker game is seeking to form a hand of cards that is as high ranking as possible. The ranking of the hands is done with reference to certain well-known hand types, which are typically referred to as: a Royal Flush; a Straight Flush; Four of a Kind; a Full House; a Flush; a Straight; Three of a Kind; Two Pair; a Pair; and High Card. Additionally, if wild cards are being used, it may be possible to form a hand of the 'Five of a Kind' type.

The exact details of the poker game implemented by the EGM 10 are immaterial so far as the bonusing is concerned, provided that, at the conclusion of each poker game, the player has a concluding hand of cards, which is referred to in relation to this embodiment as a 'combination'.

Figure 3:
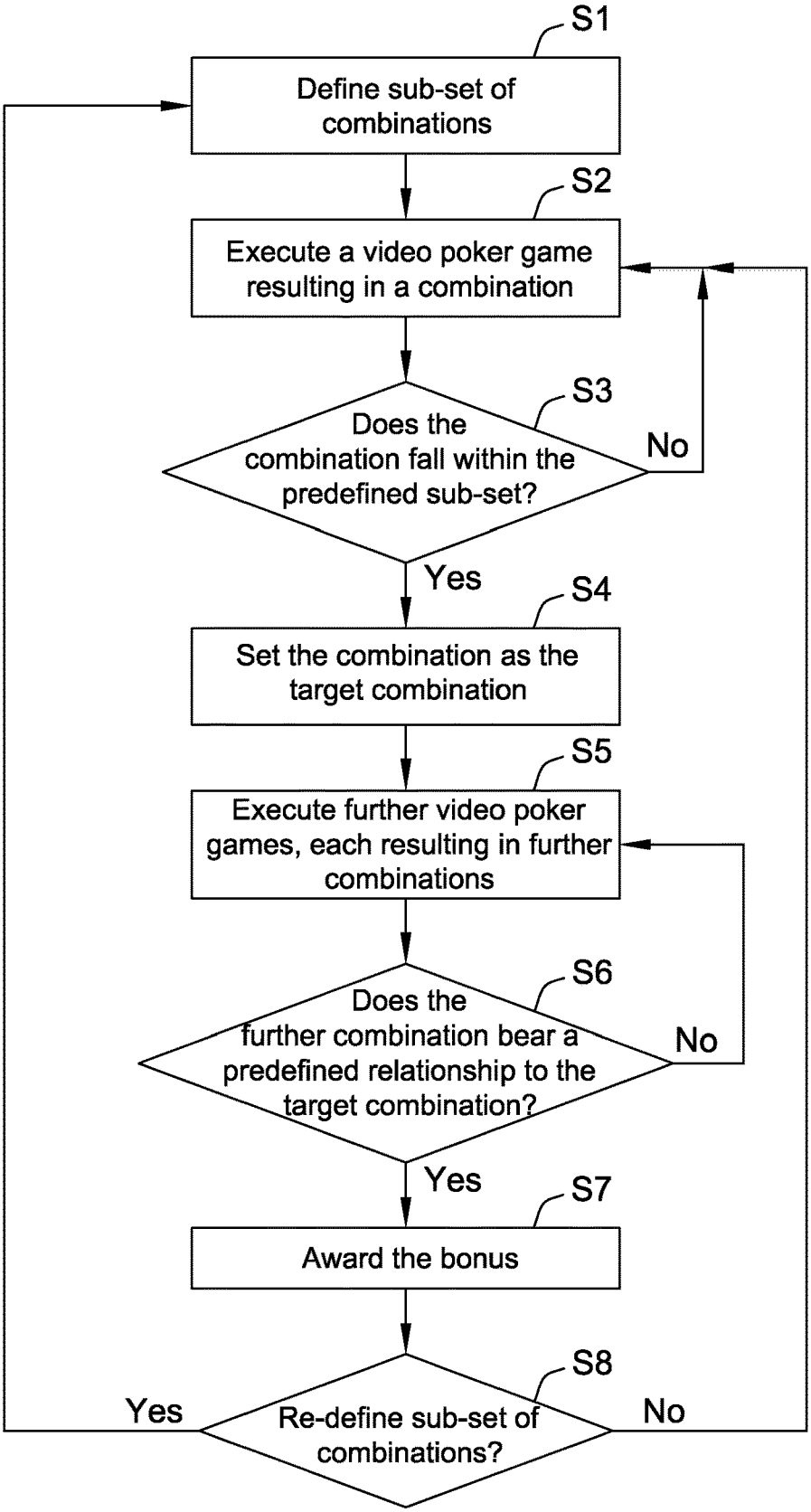
FIG. 3 is a process flow for awarding prizes in accordance with an embodiment.

Step S1 of FIG. 3 represents the commencement of the first embodiment of the bonusing method, at which it is necessary to define one of the following hand types as the 'predefined sub-set of combinations':

Royal Flush; Straight Flush; Four of a Kind; Full House; Flush; Straight; Three of a Kind; Two Pair; Pair; and High Card.

In some embodiments this is done manually by the operator of the gaming system selecting one of the above hand types and entering the details of that selection into the EGM 10 during an initialization phase. In another embodiment the EGM 10 is configured to randomly make the selection and store it in memory. For the sake of a running example, we shall assume that 'Four of a Kind' is selected as the 'sub-set of combinations'.

An embodiment of the invention also allows for the option of setting an operator-defined hand type, which may not necessarily conform to any of the standard poker hand types, as the 'predefined sub-set of combinations'. This embodiment allows the operator to define the sub-set of combinations using a rule engine as shown in FIG. 6 that includes fields for the operator to specify:

- a number of cards for the hand type;
- a relationship (such as "between", "greater than", "less than");
- a start of a range;
- an end of a range; and
- a basis for comparison (such as sharing the same rank or suit).

Some examples of 'predefined sub-sets of combinations' that an operator could define using such a rule engine include:

- "Any 4 cards between two through ace of the same rank";
- "Any four cards between ten through ace of the same suit"; and
- "Any four cards less than 5 of the same rank".

An embodiment of the invention includes an operator operable interface as shown in FIG. 7 that allows the operator to define the 'predefined sub-set of combinations' on a card-by-card basis. This interface includes fields that allow the operator to input each card's rank and/or suit. Examples of 'sub-sets of combinations' that could be defined using such an interface include:

- the first card is a two of any suit; the second card is a four of any suit; the third card is a six of any suit; the fourth card is an eight of any suit; and the fifth card is a ten of any suit; and
- the first card is a club of any rank; the second card is a spade of any rank; the third card is a heart of any rank; and the fourth card is a diamond of any rank.

At Step S2 the EGM executes a video poker game in the ordinary fashion and, once the game concludes, a 'combination' is defined (i.e. the combination is defined as the player's hand of cards at the conclusion of the poker game). In the running example, assume that the player's concluding hand in a first poker game consists of the following combination:

Ace of Clubs;
Ace of Diamonds;
8 of Spades;
8 of Clubs; and
3 of Diamonds.

At Step S3 the processor of the EGM is programmed to ascertain if the 'combination' falls within the 'predefined sub-set of combinations'. In the running example, the processor determines that the player's concluding hand is not a 'Four of a Kind' and the process flow loops back to Step S2 at which the EGM resumes play of the next poker game. This looping continues until the test at Step S3 is satisfied. Continuing the running example, assume that a subsequent game concludes with the player holding the following hand:

10 of Clubs;
10 of Spades;
10 of Diamonds;
10 of Hearts; and
6 of Spades.

At Step S3 the processor ascertains that the above combination is of the 'Four of a Kind' hand type. The processor therefore performs Step S4, at which the above five card combination is set as the 'target combination'. This is achieved by storing data defining this five card combination at a suitably allocated memory location.

Once the target combination has been stored, it is communicated to the player 14 via the EGM's display 3. This provides a reminder to the player as to the card combination that they may attempt to match in subsequent play, if they wish to try to win the bonus.

At Step S5 a further poker game is executed, which yields a 'further combination'. At Step S6 the processor checks as to whether this further combination bears a predefined relationship to the target combination that was stored to memory earlier. If not, the process flow loops back to Step S5 and this looping continues until the test at Step S6 is satisfied. Once satisfied, the bonus is awarded at Step S7. In this embodiment, the predefined relationship is equality, which means that a winning combination must precisely match the target combination, including a match of each card's suit and number. Hence, in the running example, the following further combination arising from a game executed at Step S5 would not be considered at Step S6 to bear the predefined relationship to the target combination:

10 of Clubs;
10 of Spades;
10 of Diamonds;
10 of Hearts; and
6 of Hearts.

This is because the final card of this further combination is a '6 of Hearts'; whereas the final card of the target combination in the running example is a '6 of Spades'. There is therefore an inequality between this further combination and the target combination of the running example and hence the test at Step S6 would not be satisfied and the process flow would loop back to Step S5 and this looping continues until such time as a further combination is a precise match of the target combination. In the running example, the looping between Steps S5 and S6 continues until such time as the following further combination arises at Step S5 and is tested at Step S6:

10 of Clubs;
10 of Spades;
10 of Diamonds;
10 of Hearts; and
6 of Spades.

At this point in the running example the bonus is awarded at Step S7, which in this preferred embodiment involves an increment to the EGM's credit meter by an amount constituting a bonus prize of a predefined value.

Once the bonus has been awarded, the target combination that was set earlier is no longer operative. The process flow proceeds to Step S8 at which the processor ascertains whether to re-define the sub-set. In one embodiment this only occurs if an operator has configured the system to do so. For example, the operator may configure the system to re-define the sub-set at the initialization of the EGM at the commencement of each new day of operation or based on any other desired criterion. If the sub-set is to be re-defined, then the process flow loops back to Step S1; whereas if the existing sub-set may be maintained, then the process flow loops back to Step S2 to await a new combination that falls within the predefined sub-set so as to set a new target combination.

In the above-described embodiment only a single target card combination was set. However, in alternative embodiments it is possible to define a concurrent plurality of target combinations up to a maximum permitted number of concurrent target combinations. This maximum is set by the operator. As an example, assume that the operator has set the maximum permitted number of concurrent target combinations to 3. The EGM then stores the store the first three 'Four of a Kind' combinations that arise as concurrent target combinations. Once the first of these three target combinations has been stored, it may be matched by any of the subsequent games. In other words, it is not necessary for all three of the target combinations to be set before one of them may be matched and the bonus awarded. Hence, at any one point in time in the operation of this embodiment, it is possible for the currently defined number of target combinations to be zero, one, two or three depending upon the number of target combinations that have been set and upon the number that have been rendered inoperative due to triggering an award of the bonus. The amounts of the bonus prizes awarded for each of the concurrently defined target combinations may be equal or different amounts may be defined for each of them, as desired by the operator.

Another embodiment can be configured to provide multiple bonus prizes associated with various sub-sets, for example:

Level 1—Three of a Kind—$5
Level 2—Four of a Kind—$50
Level 3—Straight Flush—$200.

In the above-described embodiment the predefined relationship was precise equality. However, in other embodiments the predefined relationship may take other forms. In one embodiment the predefined relationship is equality irrespective of card suit. Hence, if the target combination is as stated above (i.e. 10 of Clubs; 10 of Spades; 10 of Diamonds; 10 of Hearts; and 6 of Spades) then any combination would satisfy the test at Step S6 if it included the four 10's and also included a 6 of any suit. In another embodiment the predefined relationship is equality irrespective of card number.

2. Implementation on a Network of Slot Machine EGM's

This embodiment makes use of a hardware architecture shown schematically in FIG. 2. The central controller 102 communicates with a plurality of electronic gaming machines (EGMs) 10 via a network 113 that connects to a communications interface card provided on each of the EGM's. Via this communications link, it is possible for the EGM's to communicate information to the central controller 102, including information indicating that a game has concluded and information that is indicative of the combination arising from the concluded game.

In this embodiment the main game provided by the EGM's 10 is a slot machine game having five reels defining positions at which various symbols appear at the conclusion of each spin. Prizes are awarded in the slot machine game if the combination of symbols meets certain requirements, for example the presence of a certain number of matching symbols, as is well known in the art. In this embodiment the 'combination' that is used to in the bonusing method is the symbol combination that is spun during the slot machine game.

This embodiment of the method commences with a definition of a category of symbol combinations as the sub-set of combinations. For the sake of a second running example, we shall assume that the operator defines the symbol combination category "three matching symbols from left to right" as the sub-set. This information is stored in the memory of the central controller 102.

Various slot machine games are now played by a number of players using the EGM's 10. Once each game concludes, the EGM 10 on which the game was executed communicates a code to the central controller 102 which not only indicates that a game has concluded, but also identifies the specific symbol combination that was spun during the concluded game (in conjunction with information in a look-up table). Upon receipt of this signal the bonusing sub-system 108 within the central controller 102 then ascertains whether the symbol combination of the concluded game falls within the sub-set. In other words, with regard to the second running example, the processor of the bonusing sub-system 108 ascertains whether the symbol combination of the recently completed slot machine game had three matching symbols from left to right. If so, the symbol combination is set as the target combination. If not, play continues until this test is satisfied and a target symbol combination has been defined.

Once the target symbol combination has been defined the central controller 102 drives a communications module in the form of a large screen display that is positioned adjacent the EGM's 10 to communicate the target combination to the players. This large screen display also depicts information relating to the bonus, such as the amount that is available to be won.

Further slot machine games are played on the EGM's 10, generating further symbol combinations that are communicated from the EGM's 10 to the central controller 102, until such time as the target symbol combination is matched, which leads to triggering of the bonus award. More particularly, the central controller 102 sends a signal to the slot machine EGM 10 upon which the matching symbol combination was spun instructing that EGM to increment the credit meter by the bonus prize amount.

In this embodiment the bonus prize is of a progressively accumulated value. Depending upon Operator preferences, the commencement value may be zero or it may commence at a non-zero base value. As each slot machine game is completed on each of the EGM's 10, a percentage contribution of the game's turnover is communicated from the EGM to the central controller 102, which increments the prize value by the amount of the contribution. This progressive accumulation commences upon a setting of the target combination and ceases upon an award of the bonus prize. Hence, if there is relatively continuous gaming activity across the linked EGM's during this period, then the longer it takes to award the bonus prize, the higher the amount that is awarded.

Once the bonus has been awarded, the target symbol combination is no longer operative. Depending upon operator preferences, the process flow may commence again from the step of defining the sub-set. Alternatively, if it is not necessary to re-define the sub-set, the process recommences with the same sub-set.

In an alternative embodiment, the predefined sub-set of combinations is the set of symbol combinations having a common predefined pay level. For example, the operator may wish to define the sub-set as being all symbol combinations that yield a pay level of, say, '150 times the amount bet'. The system would then wait for a symbol combination that yields the predefined pay level to be spun and set that symbol combination as the target combination for subsequent games.

3. Player Tracking Modules on Standard Video Poker EGM's

This embodiment starts with one or more standard video poker EGM's 10 (i.e. EGM's that provide games of poker, but which have not been configured to provide the bonusing method) and retrofits a player tracking module 6, as shown for example in FIG. 5, onto each of them. These player tracking modules 6 can communicate with their respective EGM 10 and can be programmed to perform the functions that were otherwise performed by the central controller 102 in the embodiment described above. In this way, the functionality of one or more standard video poker EGM's 10 can be extended to include the provision of the bonusing method. Additionally, the functionality of the player tracking modules 6 allows for bonus prizes to be awarded in the form of points in a promotional reward redemption scheme.

4. Embodiments Using Randomly Generated Combinations

Another embodiment does not make explicit use of a combination extracted from a main game provided by the EGM. Hence, this embodiment does not require an interface to the EGM that is capable of communicating combinations arising from the conclusion of main games. Rather, in this embodiment a player tracking module 6 is programmed to receive a signal from the EGM that merely indicates that a game has concluded (but which does not necessarily include any details identifying any combinations). Upon receipt of this signal, the processor of the player tracking module 6 randomly generates a combination, which is effectively treated by the bonusing method as a combination defined by the game that has just been concluded either for the purpose of defining a target combination or the purpose of potentially matching a previously defined target combination. In other respects, this embodiment of the bonusing system may be configured to function in the manner of any one of the embodiments described above. It will be appreciated that this approach allows the bonusing method to be used with virtually any EGM, regardless of the type of main game implemented on that EGM.

Another embodiment that functions in a similar manner to that described in the preceding paragraph is implemented on slot machine EGM's upon which player tracking modules 6 have been installed. At the end of each slot machine game, the player tracking module 6 is programmed to randomly generate a seven card combination, which is treated in the bonusing method as a combination defined by the slot machine game that has just been concluded. The seven card combination is displayed to the player via the display 14 on the player tracking module 6, along with a display of any currently defined target combinations. In yet another similar embodiment, the player tracking module 6 is programmed to randomly generate a five card combination and the directional buttons 15 are used by the player to choose cards to hold and cards to dump as per a typical poker game. Once the dumped cards have been replaced, the combination is defined and the bonusing method may proceed in the manner of any one of the embodiments described above. In a variation of this embodiment, the player tracking module 6 is programmed to randomly generate a single seven card combination if the concluded slot machine game was at less than maximum bet. However, the player tracking module 6 is programmed to randomly generate three of the seven card combinations if the concluded slot machine game was at the maximum bet. In this way, players choosing to play the slot machine at the maximum bet level are rewarded with a greater chance of winning the bonus prize.

5. Display Boards for a Networked Poker System

In a networked poker EGM embodiment upon which a plurality of concurrent target combinations are provided, an example of a large screen display intended to communicate with the players of the linked EGM's is given below:

| Straight flush | | straight | | four of a kind | | three of a kind | |
|---|---|---|---|---|---|---|---|
| Club 3, 4, 5, 6, 7, 8 | $2,345.00 | 7, 8, 9, 10, J | $400.00 | 3's | $120.00 | S's | $21.23 |
| | | 2, 3, 4, 5, 6, 7 | $286.45 | j's | $108.89 | 2's | $18.45 |
| | | | | Ts | $ 98.45 | Ts | $12.34 |
| Hot hands | | hot hands | | hot hands | | hot hands | |
| | | | | Ts<br>Q's | | | |
| Money hands | | money hands | | money hands | | money hands | |
| | | | | 3's<br>2's | | | |

The upper half of this display informs the players of the various target combinations that are currently applicable and their associated currently accumulated prize amounts. In the above example the display indicates that one of the target combinations is of the 'Straight Flush' type. Two of the target combinations are of the 'Straight' type. Three of the target combinations are of the 'Four of a Kind type' and another three of the target combinations are of the 'Three of a Kind' type. Once any of these combinations is matched, and the respective bonus prize awarded, the leader board is updated to firstly notify the players of the fact that a prize has been awarded and secondly to remove the spent target combination from the list. Once a replacement target combination has been defined, it is added to the list, along with its respective prize amount.

The lower half of this display informs the players of statistical information relating to previous awards of the bonus. In particular, the 'Hot Hands' section informs the players of the hands that have recently triggered awards with the highest frequency. The 'Money Hands' section informs the players of the hands that have recently triggered awards with the highest award amounts.

It will be appreciated that embodiments of the present invention give players of well known games, such as video poker EGMs and slot machine EGMs, increased options for game strategies. For example, in a normal five card video poker game, a player who receives a flop of, say:

King of Clubs;
Queen of Clubs;
Jack of Clubs;
7 of Hearts; and
7 of Spades is likely to dump the 7 of Hearts and 7 of Spades in the hopes of receiving two replacement cards that give a straight flush. However, if playing an EGM on which the present bonusing method is implemented, and if the target combination is, say:

'King of Clubs'
'7 of Hearts';
'7 of Spades';
'7 of Clubs'; and
'7 of Diamonds' then the player also has the option of dumping the Queen of Clubs and the Jack of Clubs in the hopes of receiving two replacement cards that would allow the player's hand at the conclusion of the poker game to match the target combination (i.e. 7 of Clubs and 7 of Diamonds) and thereby trigger the award of the bonus prize.

5. Awarding a Bonus at then-Th Match

Figure 8:
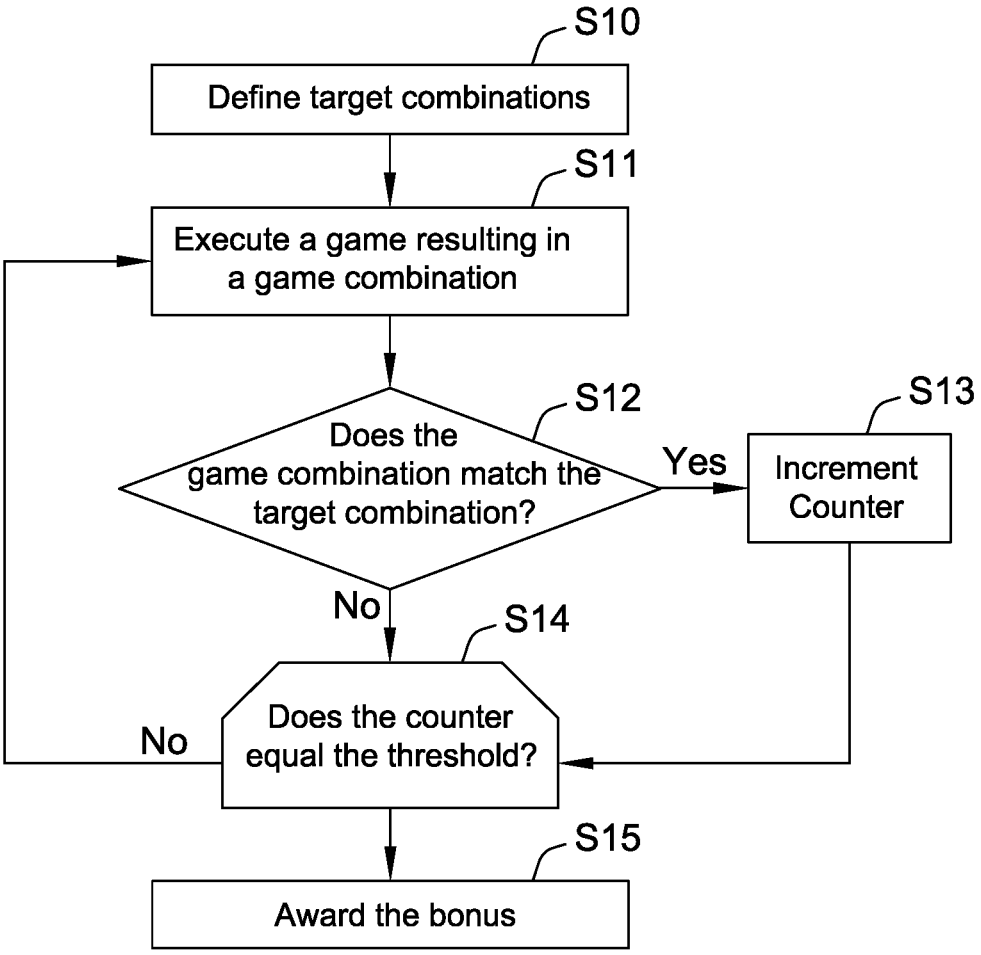
FIG. 8 is a process flow for awarding prizes in accordance with another embodiment.

FIG. 8 illustrates another method of awarding a bonus, which commences at step S10 with a definition of a target combination. In one embodiment this target combination is defined by the operator. In another embodiment, the steps S1 to S4 as shown in FIG. 3 are used to define the target combination. As described in detail above, steps S2 and S3 are repeatedly executed until the target combination is defined. For the sake of a running example we shall assume that the operator makes use of the interface depicted in FIG. 7 to define the target combination as the following 'Two Pair' poker hand:

Jack of Hearts;
Jack of Spades;
4 of Clubs;
4 of Spades;
9 of Hearts.

At step S10 a counter variable is initialized to a value of zero. Additionally, at step S10 a threshold variable is initialized to a value that is preferably greater than two, and which in the running example is ten.

At step S11 a video poker game is executed on an EGM and the poker hand held at the conclusion of the game is defined to be the game combination. For the sake of the running example we shall assume that the first game combination differs from the target combination.

At step S12 the processor compares the game combination to the target combination to ascertain if they bear a predefined relationship to each other. In particular, the processor ascertains whether they are identical. In the running example they are not identical and hence the process flow proceeds to step S14.

At loop limiting step S14 the processor compares the value of the counter variable to the value of the threshold. In the running example, the counter variable is still at its initialized value of zero and the threshold is equal to ten. The processor therefore ascertains that these two values are not equal and hence the process flow loops back to step S11. This looping continues until such time as a game combination matches the target combination. In terms of the running example, the looping continues until the above-stated 'Two Pair' poker hand arises as a game combination. Once this occurs the comparison at step S12 is positive and the process flow proceeds to step S13, at which the value of the counter variable is adjusted by incrementing it by one. Hence, in the running example, the value of the counter variable is incremented from zero to one.

To increase player excitement and engagement, a visible and audible alert is provided each time the counter is incremented at step S13. In one embodiment the visual alert is provided by a display, which shows the current value of the counter. The rules of the bonus game inform the players of the threshold value (which in the running example is ten). Hence, as the displayed number gets closer to the threshold, player excitement is anticipated to rise.

The looping between steps S11 and S14 continues until nine further matches of the target occur, by which point the value of the counter has been incremented to ten. Hence, the next time the processor performs the comparison at step S14 it determines that the value of the counter variable bears a predefined relationship with (i.e. is equal to) the value of the threshold variable and the process flow therefore proceeds to step S15 at which the bonus is awarded.

In one embodiment all of the games are executed on a single EGM and, in this embodiment, the bonus is awarded at step S15 to the player of that EGM. However, in other embodiments the games are executed on a plurality of communicatively linked EGM's and various embodiments feature different methodologies for selecting the one or more EGM's to which to award the bonus at step S15. In one such embodiment the bonus is awarded to the EGM that caused the counter to equal the threshold. In other words, with reference to the running example, the bonus is awarded to the EGM that executed the tenth game to yield a game combination that matched the 'Two Pair' poker hand target combination.

In another embodiment on which the games are executed on a plurality of communicatively linked EGM's, the bonus is awarded to the player of an EGM that is randomly selected from amongst the currently active EGM's that satisfy an operator-selected criterion. The operator may select the criterion as being associated with a current session time. For example, the criterion for inclusion in the group of EGM's from which the bonus winner is randomly selected may be only those players who have been playing for more than a threshold length of time. Alternatively, or additionally, the operator may select the criterion as being associated with each EGM's reported turnover within the current session. For example, the criterion for inclusion in the group of EGM's from which the bonus winner is randomly selected may be only those EGM's that have had an average turnover that exceeds a threshold dollar value. Alternatively, or additionally, the operator may select the criterion as being associated with participation in a player tracking scheme. For example, the criterion for inclusion in the group of EGM's from which the bonus winner is randomly selected may be only those EGM's into which a player tracking card has been inserted.

In yet another embodiment on which the games are executed on a plurality of communicatively linked EGM's, the bonus is divided amongst players of a subset of currently active EGM's. In one such embodiment the bonus is equally divided amongst the subset of EGM's. In another such embodiment a major component of the bonus is awarded to the player of the EGM that caused the counter to equal the threshold and the remainder of the bonus is divided equally amongst the other EGM's within the subset of currently active EGM's. In a similar manner to that disclosed in the preceding paragraph, the subset of currently active EGM's may be defined with reference to one or more operator-defined criteria, such as current session time, average EGM turnover dollar value within the current session and/or participation in a player tracking scheme.

In the above-described embodiment the target combination was a single poker hand. However, other embodiments utilize multiple target combinations, such as a plurality of operator-defined poker hands. Yet other embodiments define the target combinations as a sub-set of combinations, for example a particular type of poker hand, such as a flush, for example. This may be defined by the operator making use of the interface depicted in FIG. 6 to select "Flush" as the poker hand type. In this embodiment, any game combination that is a flush is considered to match the target combination in the comparison step S12.

6. Matrix Embodiment

Figure 9:
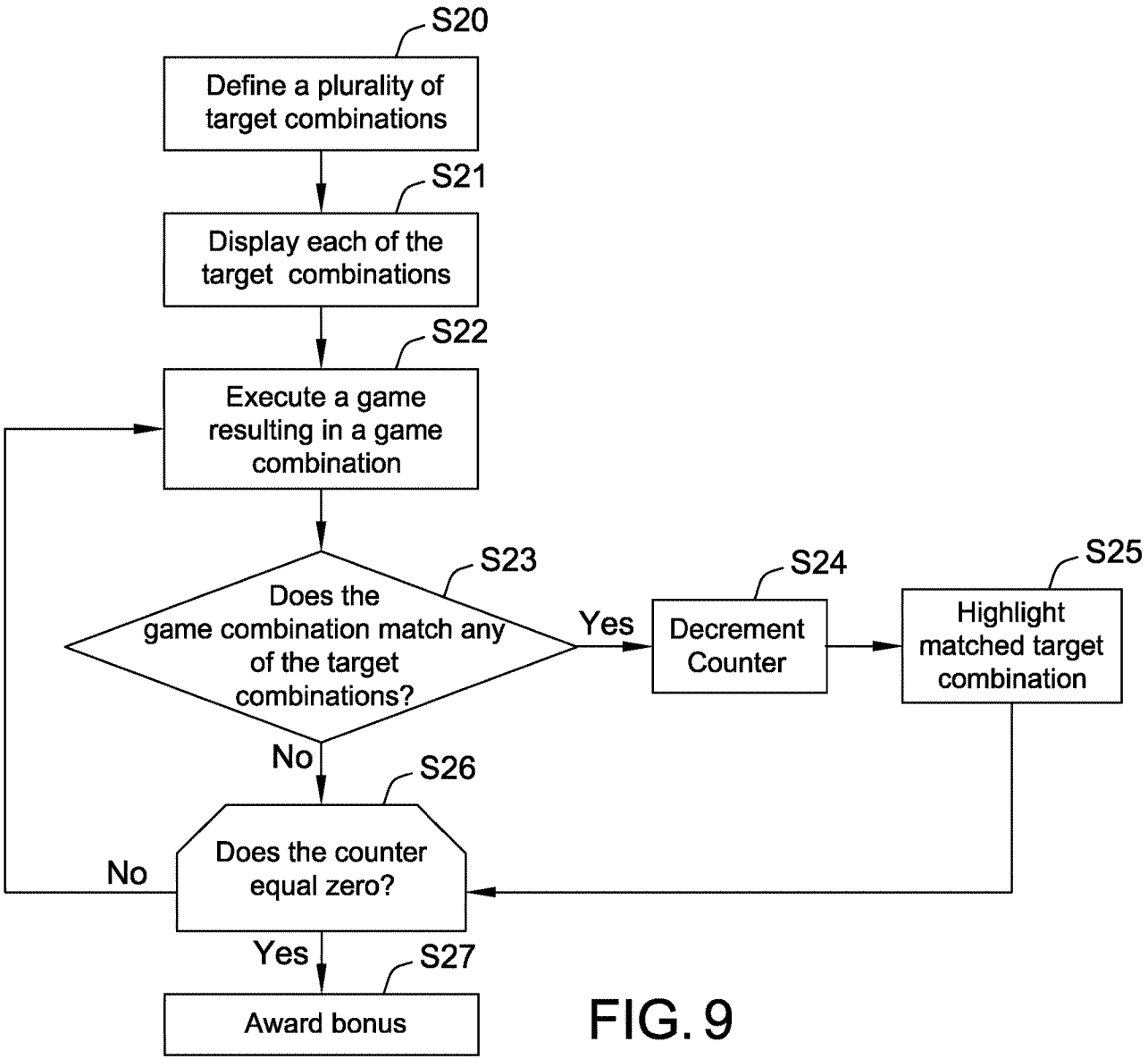
FIG. 9 is a process flow for awarding prizes in accordance with yet another embodiment.

FIG. 9 depicts another embodiment of a method of awarding a bonus. The method commences at step S20 with the definition of a plurality of target combinations. For the sake of a running example, we shall assume that the operator uses the interface depicted in FIG. 6 to specify "any four of a kind less than value 3" as the hand type that defines the plurality of target combinations. Alternatively, rather than relying upon a pre-defined hand type, the operator may use the interface depicted in FIG. 7 to specifically define each of the target combinations on a card-by-card basis.

At step S21 the central controller 102 drives the display so as to depict each of the target combinations. With regard to the running example, the display shows all possible "four of a kind less than value 3" combinations. All of the combinations are initially depicted in a grayed-out manner so as to form a matrix of combinations on the display. Additionally, the processor counts the total number of target combinations, saves that value to a counter variable and displays the number on the display.

At step S22 a video poker game is executed on one of the communicatively linked EGM's and the player's hand as held at the conclusion of the game defines a game combination.

At step S23 the processor of the central controller 102 conducts a comparison to ascertain if the game combination matches any of the target combinations. In the running example, if the game combination is not a "four of a kind less than value 3", then the process flow proceeds to step S25. However, if the game combination is a "four of a kind less than value 3", then the process flow proceeds to step S24.

At step S24 the processor decrements the counter variable by one and the new lower value is displayed to the players on the display. The process flow then proceeds to step S25 at which the processor drives the display so as to highlight the particular target combination that has been matched by the game combination. Hence, it is possible for the players to check which of the target combinations have been matched thus far simply by looking for the target combinations that have been highlighted (as compared to those that are still grayed-out). Additionally, the players can check the value of the counter that is depicted on the display, with the knowledge that a low value indicates that only few combinations remain unmatched.

Optionally, at step S25 an audible alarm may be sounded to alert patrons that another target combination has been matched, with the intention of heightening player excitement and engagement.

At step S26 the processor determines if each of the target combinations has been respectively matched by a game combination. The determination is done by checking if the counter is equal to zero. If the counter has a non-zero value, then the process flow loops back to step S22 and further games are executed until such time as all of the target combinations have been matched. However, if the counter has a value of zero, this indicates that each of the target combinations has been respectively matched by a game combination and the bonus is awarded at step S27.

In the embodiment described above the games are executable on a plurality of communicatively linked electronic gaming machines (EGM's) and the target combinations are respectively matchable by game combinations arising from games executed on any one of the EGM's. In this sense, the currently active group of players effectively work together with the aim of matching all of the target combinations. When awarding the bonus at step S27, the central controller may simply award all of the bonus funds to the EGM that matched the final target combination. However, in other embodiments, the central controller may utilize one of the methodologies described above so as to determine a subset of EGM's from which to randomly select an EGM to receive the bonus; or so as to determine a sub-set of currently active EGM's amongst which to divide the bonus.

In another embodiment the games are executable on a single electronic gaming machine (EGM) and the target combinations are respectively matchable by game combinations arising solely from games executed on that single EGM. In this embodiment the bonus is simply awarded to the player of that single EGM.

Further aspects of the method will be apparent from the above description of the gaming system. Persons skilled in the art will also appreciate that the method could be embodied in program code. The program code could be supplied in a number of ways, for example on a computer readable medium, such as a disc or a memory (for example, that could replace part of memory) or as a data signal (for example, by downloading it from a server).

It is to be understood that various alterations, additions and/or modifications may be made to the parts and methods previously described without departing from the ambit of the present invention, and that, in the light of the above teachings, the present invention may be implemented in software, firmware and/or hardware in a variety of manners as would be understood by a person skilled in the art.

It is to be understood that, if any prior art is referred to herein, such reference does not constitute an admission that the prior art forms a part of the common general knowledge in the art in any country.

The invention claimed is:

1. A method of adding increased options to a poker game implemented by a game controller an electronic gaming machine (EGM), the EGM including an EGM player interface, an EGM display, and the game controller, the game controller comprising at least one GC processor, the method comprising:

retrofitting a player tracking module to the EGM, the player tracking module comprising at least one PTM processor, a PTM reading device configured to read a portable storage medium, a PTM display, and a player operable PTM input device, the at least one PTM processor in communication with the at least one GC processor;

receiving, by the at least one GC processor via the EGM player interface, an input to initiate a gaming session comprising a plurality of instances of a poker game;

for each of the instances of the game, by the at least one GC processor independently from the PTM processor, (i) randomly generating an initial combination of cards, (ii) causing to be displayed, on the EGM display, the initial combination of cards, (iii) receiving, from the EGM player interface, a selection of at least one card of the initial combination of cards to discard, (iv) randomly generating at least one replacement card, (v) causing to be displayed, on the EGM display, a game-outcome combination of cards for the instance, wherein the game-outcome combination modifies the displayed initial-game combination by replacing the at least one card selected for discard with the at least one replacement card, and (vi) crediting a credit balance associated with a player of the EGM if the game-outcome combination of cards is one of a plurality of winning outcomes;

establishing, by the at least one PTM processor, a counter value and a threshold value by storing the counter value and the threshold value in a memory device;

initializing, by the at least one PTM processor, the counter value to zero;

setting, by the at least one PTM processor, the threshold value at a value greater than zero;

receiving, by the at least one PTM processor from the at least one GC processor at a conclusion of each of the instances of the game, the respective game-outcome combination of cards for the instance;

subsequently to the step performed by the at least one GC processor of crediting the credit balance if the game-outcome combination of cards for a first instance of the game is one of the plurality of winning outcomes, determining, by the at least one PTM processor, that the game-outcome combination of cards for the first instance is one of a predefined sub-set of combinations in a predefined sub-set of poker hands, and, in response, setting the game-outcome combination of cards for the first instance as a target combination of cards in a target poker hand to be matched during a further game;

causing, by the at least one PTM processor during the display of the initial combination of cards for a second instance of the game subsequent to the first instance, the target poker hand and the counter value to be displayed on at least one of the EGM display and the PTM display, wherein the initial combination of cards for the second instance includes a first subset of cards partially matching one of the plurality of winning outcomes and a second subset of cards partially satisfying a predefined matching relationship with the target poker hand, such that the at least one card of the initial combination of cards to discard for the second instance executed by the at least one GC processor is informed by both the plurality of winning outcomes implemented by the at least one GC processor and the target combination set by the at least one PTM processor;

subsequently to the step performed by the at least one GC processor of crediting the credit balance if the game-outcome combination of cards for the second instance is one of the plurality of winning outcomes, comparing, by the at least one PTM processor, the game-outcome combination of cards for the second instance to the target combination of cards in the target poker hand to determine whether the game-outcome combination of cards for the second instance satisfies the predefined matching relationship as compared to the target combination of cards in the target poker hand;

one of: i) incrementing, by the at least one PTM processor within the memory device and on the corresponding display, the counter value in response to determining that the game-outcome combination of cards for the second instance satisfies the predefined matching relationship to the target combination of cards in the target poker hand, or ii) holding the counter value static in the memory in response to determining, by the at least one PTM processor, that the game-outcome combination of cards for the second instance does not satisfy the predefined matching relationship to the target combination of cards in the target poker hand;

comparing, by the at least one PTM processor, the counter value to the threshold value; and one of: i) awarding, by the at least one PTM processor, a bonus to the credit balance associated with the player if the counter value is equal to the threshold value, or ii) continuing to execute, by the at least one GC processor, one or more additional instances of the game to generate one or more additional game-outcome combinations until the counter value reaches the threshold value.

2. The method according to claim 1 wherein the predefined matching relationship is equality.

3. The method according to claim 1 further comprising receiving, by the at least one PTM processor, an input from a casino operator prior to execution of the first instance of the game, the input including the predefined sub-set of combinations.

4. The method according to claim 1 wherein the one of the predefined sub-set of combinations includes one of a Royal Flush, a Straight Flush, a Four of a Kind, a Full House, a Flush, a Straight, a Three of a Kind, a Two Pair, a Pair, and a High Card.

5. The method according to claim 1 wherein the predefined sub-set of combinations are randomly determined.

6. The method according to claim 1 wherein the predefined matching relationship is rank equality irrespective of card suit.

7. The method according to claim 1 wherein the predefined matching relationship is suit equality irrespective of card rank.

8. The method according to claim 1 wherein the game is a slot machine game.

9. At least one non-transitory computer readable storage medium for use with an electronic gaming machine (EGM), the EGM including an EGM player interface, an EGM display, a game controller comprising at least one GC processor, and a player tracking module, the player tracking module comprising at least one PTM processor, a PTM reading device configured to read a portable storage medium, a PTM display, and a player operable PTM input device, the at least one PTM processor in communication with the at least one GC processor, the at least one non-transitory computer readable storage medium having first and second sets of instructions stored thereon, the first set for execution by the at least one GC processor and the second set for execution by the at least one PTM processor after the player tracking module is retrofitted to the EGM, wherein:

when executed by the GC processor, the first set of instructions cause the at least one GC processor to at least:

receive, via the EGM player interface, an input to initiate a gaming session comprising a plurality of instances of a poker game;

for each of the instances of the game, independently from the PTM processor, (i) randomly generate an initial combination of cards, (ii) cause to be displayed, on the EGM display, the initial combination of cards, (iii) receive, from the EGM player interface, a selection of at least one card of the initial combination of cards to discard, (iv) randomly generate at least one replacement card, (v) cause to be displayed, on the EGM display, a game-outcome combination of cards for the instance, wherein the game-outcome combination modifies the displayed initial-game combination by replacing the at least one card selected for discard with the at least one replacement card, and (vi) credit a credit balance associated with a player of the EGM if the game-outcome combination of cards is one of a plurality of winning outcomes; and when executed by the PTM processor, the second set of instructions cause the at least one PTM processor to at least:

establish a counter value and a threshold value by storing the counter value and the threshold value in a memory device;

initialize the counter value to zero;

set the threshold value at a value greater than zero;

receive, from the at least one GC processor at a conclusion of each of the instances of the game, the respective game-outcome combination of cards for the instance;

subsequently to the step performed by the at least one GC processor of crediting the credit balance if the game-outcome combination of cards for a first instance of the game is one of the plurality of winning outcomes, determine that the game-outcome combination of cards for the first instance is one of a predefined sub-set of combinations in a predefined sub-set of poker hands, and, in response, set the game-outcome combination of cards for the first instance as a target combination of cards in a target poker hand to be matched during a further game;

cause, during the display of the initial combination of cards for a second instance of the game subsequent to the first instance, the target poker hand and the counter value to be displayed on at least one of the EGM display and the PTM display, wherein the initial combination of cards for the second instance includes a first subset of cards partially matching one of the plurality of winning outcomes and a second subset of cards partially satisfying a predefined matching relationship with the target poker hand, such that the at least one card of the initial combination of cards to discard for the second instance executed by the at least one GC processor is informed by both the plurality of winning outcomes implemented by the at least one GC processor and the target combination set by the at least one PTM processor;

subsequently to the step performed by the at least one GC processor of crediting the credit balance if the game-outcome combination of cards for the second instance is one of the plurality of winning outcomes, compare the game-outcome combination of cards for the second instance to the target combination of cards in the target poker hand to determine whether the game-outcome combination of cards for the second instance satisfies the predefined matching relationship as compared to the target combination of cards in the target poker hand;

one of: i) increment, within the memory and on the corresponding display, the counter value in response to determining that the game-outcome combination of cards for the second instance satisfies the predefined matching relationship to the target combination of cards in the target poker hand, or ii) hold the counter value static in the memory in response to determining that the game-outcome combination of cards for the second instance does not satisfy the predefined matching relationship to the target combination of cards in the target poker hand;

compare the counter value to the threshold value; and when executed by the PTM processor, the second set of instructions further cause the at least one PTM processor to award a bonus to the credit balance associated with the player if the counter value is equal to the threshold value, and when executed by the GC processor, the first set of instructions cause the at least one GC processor to continue to execute one or more additional instances of the game to generate one or more additional game-outcome combinations until the counter value reaches the threshold value.

10. The at least one non-transitory computer-readable storage medium according to claim 9 wherein the second set of instructions further cause the at least one PTM processor to receive an input from a casino operator prior to execution of the first instance of the game, the input including the predefined sub-set of combinations.

11. An electronic gaming machine (EGM) comprising a credit input mechanism, an EGM player interface, an EGM display, a game controller, and a player tracking module retrofitted to the EGM, the game controller comprising at least one GC processor and the player tracking module comprising at least one PTM processor, a PTM reading device configured to read a portable storage medium, a PTM display, and a player operable PTM input device, the at least one PTM processor in communication with the at least one GC processor, wherein:

the at least one GC processor is configured to:

receive, via the credit input mechanism, a credit input by a player for contribution to a credit balance associated with the player;

receive, via the EGM player interface, a wager input by the player to initiate a gaming session comprising a plurality of instances of a poker game;

for each of the instances of the game, independently from the PTM processor, (i) randomly generate an initial combination of cards, (ii) cause to be displayed, on the EGM display, the initial combination of cards, (iii) receive, from the EGM player interface, a selection of at least one card of the initial combination of cards to discard, (iv) randomly generate at least one replacement card, (v) cause to be displayed, on the EGM display, a game-outcome combination of cards for the instance, wherein the game-outcome combination modifies the displayed initial-game combination by replacing the at least one card selected for discard with the at least one replacement card, and (vi) credit the credit balance associated with a player of the EGM if the game-outcome combination of cards is one of a plurality of winning outcomes;

the at least one PTM processor is configured to:

establish a counter value and a threshold value by storing the counter value and the threshold value in a memory device;

initialize the counter value to zero;

set the threshold value at a value greater than zero;

receive, from the at least one GC processor at a conclusion of each of the instances of the game, the respective game-outcome combination of cards for the instance;

subsequently to the step performed by the at least one GC processor of crediting the credit balance if the game-outcome combination of cards for a first instance of the game is one of the plurality of winning outcomes, determine that the game-outcome combination of cards for the first instance is one of a predefined sub-set of combinations in a predefined sub-set of poker hands, and, in response, set the game-outcome combination of cards for the first instance as a target combination of cards in a target poker hand to be matched during a further game;

cause, during the display of the initial combination of cards for a second instance of the game subsequent to the first instance, the target poker hand and the counter value to be displayed on at least one of the EGM display and the PTM display, wherein the initial combination of cards for the second instance includes a first subset of cards partially matching one of the plurality of winning outcomes and a second subset of cards partially satisfying a predefined matching relationship with the target poker hand, such that the at least one card of the initial combination of cards to discard for the second instance executed by the at least one GC processor is informed by both the plurality of winning outcomes implemented by the at least one GC processor and the target combination set by the at least one PTM processor;

subsequently to the step performed by the at least one GC processor of crediting the credit balance if the game-outcome combination of cards for the second instance is one of the plurality of winning outcomes, compare the game-outcome combination of cards for the second instance to the target combination of cards in the target poker hand to determine whether the game-outcome combination of cards for the second instance satisfies the predefined matching relationship as compared to the target combination of cards in the target poker hand;

one of: i) increment, within the memory and on the corresponding display, the counter value in response to determining that the game-outcome combination of cards for the second instance satisfies the predefined matching relationship to the target combination of cards in the target poker hand, or ii) hold the counter value static in the memory in response to determining that the game-outcome combination of cards for the second instance does not satisfy the predefined matching relationship to the target combination of cards in the target poker hand;

compare the counter value to the threshold value; and the at least one PTM processor is further configured to i) award a bonus to the credit balance associated with the player if the counter value is equal to the threshold value, and the at least one GC processor is further configured to continue to execute one or more additional instances of the game to generate one or more additional game-outcome combinations until the counter value reaches the threshold value.

12. The EGM according to claim 11 wherein the predefined matching relationship is equality.

13. The EGM according to claim 11 wherein the at least one PTM processor is further configured to receive an input from a casino operator prior to execution of the first instance of the game, the input including the predefined sub-set of combinations.

14. The EGM according to claim 11 wherein the one of the predefined sub-set of combinations includes one of a Royal Flush, a Straight Flush, a Four of a Kind, a Full House, a Flush, a Straight, a Three of a Kind, a Two Pair, a Pair, and a High Card.

15. The EGM according to claim 11 wherein the at least one PTM processor is further configured to randomly determine the predefined sub-set of combinations.

16. The EGM according to claim 11 wherein the predefined matching relationship is rank equality irrespective of card suit.

17. The EGM according to claim 11 wherein the predefined matching relationship is suit equality irrespective of card rank.

18. The EGM according to claim 11 wherein the game is a slot machine game.

* * * * *